US010727039B2

(12) United States Patent
Hamish et al.

(10) Patent No.: US 10,727,039 B2
(45) Date of Patent: Jul. 28, 2020

(54) MASS SPECTROMETER AND METHOD FOR TIME-OF-FLIGHT MASS SPECTROMETRY

(71) Applicant: Thermo Fisher Scientific (Bremen) GmbH, Bremen (DE)

(72) Inventors: Stewart Hamish, Bremen (DE); Dmitry Grinfeld, Bremen (DE); Alexander Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 16/011,464

(22) Filed: Jun. 18, 2018

(65) Prior Publication Data

US 2018/0366312 A1 Dec. 20, 2018

(30) Foreign Application Priority Data

Jun. 20, 2017 (GB) ..... 1709789.0

(51) Int. Cl.
*H01J 49/40* (2006.01)
*H01J 49/42* (2006.01)

(52) U.S. Cl.
CPC ..... *H01J 49/405* (2013.01); *H01J 49/403* (2013.01); *H01J 49/422* (2013.01); *H01J 49/406* (2013.01)

(58) Field of Classification Search
CPC ..... H01J 49/403; H01J 49/406
See application file for complete search history.

(56) References Cited

U.S. PATENT DOCUMENTS

| | | | | |
|---|---|---|---|---|
| 5,569,917 | A | 10/1996 | Buttrill, Jr. et al. | |
| 6,441,369 | B1 | 8/2002 | Vestal et al. | |
| 7,897,916 | B2 | 3/2011 | Sudakov et al. | |
| 2007/0029473 | A1* | 2/2007 | Verentchikov ..... | H01J 49/406 250/281 |
| 2013/0068944 | A1 | 3/2013 | Raptakis et al. | |
| 2015/0028197 | A1 | 1/2015 | Grinfeld et al. | |
| 2015/0028198 | A1 | 1/2015 | Grinfeld et al. | |

FOREIGN PATENT DOCUMENTS

| | | | |
|---|---|---|---|
| EP | 2346065 | A1 | 7/2011 |
| GB | 2401243 | A | 11/2004 |
| WO | 2005/114699 | A1 | 12/2005 |
| WO | 2010/007373 | A1 | 1/2010 |

* cited by examiner

*Primary Examiner* — Eliza W Osenbaugh-Stewart
(74) *Attorney, Agent, or Firm* — Charles B. Katz

(57) ABSTRACT

A mass spectrometer comprising: a pulsed ion source for generating pulses of ions having a range of masses; a time-of-flight mass analyzer for receiving and mass analyzing the pulses of ions from the ion source; and an energy controlling electrode assembly located between the pulsed ion source and the time-of-flight mass analyzer configured to receive the pulses of ions from the pulsed ion source and apply a time-dependent potential to the ions thereby to control the energy of the ions depending on their m/z before they reach the time-of-flight mass analyzer. Mass dependent differences in average energy of ions can be reduced for injection into a time-of-flight mass analyzer, which can improve ion transmission and/or instrument resolving power.

30 Claims, 4 Drawing Sheets

MASS SPECTROMETER AND METHOD FOR TIME-OF-FLIGHT MASS SPECTROMETRY

FIELD OF THE INVENTION

This invention relates to the field of time-of-flight (TOF) mass spectrometry. The invention provides a time-of-flight mass spectrometer and method of time-of-flight mass spectrometry.

BACKGROUND

Time-of-flight (TOF) mass spectrometry involves the acceleration of a pulse of ions from a pulsed ion source, through a flight region where they separate according to their velocity, which is dependent on their mass to charge ratio (m/z), and reach a detector where their times-of-flight are recorded. The times of flight of the ions are then typically converted to their m/z values. Thus, a mass spectrum of the ions can be measured.

Commonly, an ion mirror or other focusing device is used to bring ions with differing energies but the same m/z to an isochronous focal plane, thereby maximising the mass resolution. Various arrangements utilizing multi-reflection to extend the flight path of ions within mass spectrometers are known. Flight path extension is desirable to increase time-of-flight separation of ions within time-of-flight (TOF) mass spectrometers. The ability to distinguish small mass differences between ions (the mass resolving power or resolution) is thereby improved. Improved resolving power, along with advantages in increased mass accuracy and sensitivity that typically accompany it, is an important attribute for a mass spectrometer for a wide range of applications, particularly with regard to applications in biological science, such as proteomics and metabolomics, for example. With flight path extension in certain designs of mass spectrometer however, it can be a problem to maintain a sufficiently high ion transmission.

US2015/0028197 A and US 2015/0028198 A disclose a type of multi-reflection mass spectrometer having an extended flight path wherein two ion mirrors oppose each other in a direction X and both mirrors are generally elongated in a drift direction Y, orthogonal to direction X. Ions injected into the spectrometer are repeatedly reflected back and forth in the X direction between the mirrors, whilst they drift down the Y direction of mirror elongation. Overall, the ion motion follows a zigzag path. The mirrors have a convergence with increasing Y, thereby creating a pseudo-potential gradient along the Y axis that acts as an ion mirror to reverse the ion drift velocity along Y and spatially focus the ions in Y to a focal point where a detector is placed, typically near to the region of ion injection.

In TOF mass spectrometers, ions are typically extracted from an ion source by a pulsed extraction electric field generated by a pulsed high voltage. Examples of such systems are disclosed in U.S. Pat. Nos. 5,569,917 and 7,897,916, which show means of ion extraction from an RF ion trap source. In TOF mass spectrometry, pulsed ion extraction involving pulsed high voltages from an ion source using MALDI and/or orthogonal acceleration are also common.

A problem arising with such methods is that the rise time of the pulsed extraction voltage has been found to induce a mass dependent perturbation to the kinetic energy of the extracted ions, as ions of different m/z separate spatially within the source, traversing a varying portion of the extraction field before the field reaches its maximum strength.

Thus, relatively lighter ions can exit the ion source with a substantially lower energy than relatively higher m/z ions if the rise time is too long. High extraction fields, which are desirable to minimise the ion turnaround time within the ion source and to improve mass resolution, exacerbate the problem.

This problem is usually limited to low mass ions (e.g. m/z <200) and in conventional time-of-flight instruments incorporating an ion mirror it does not present a severe problem as they are normally tolerant to energy deviations of >200 eV. However, the inventors have found that in certain complex time-of-flight analyzer designs, such as that shown in US 2015/0028198 A1 for example, that incorporate a long, highly folded ion flight path, the transmission of the ions to a final detector can be dependent on the ions having a narrow ion energy range, e.g. less than 200 eV.

One strategy to solve the problem is to limit the appearance of the energy perturbation in the first place. This can be done, for example, by reducing the rise time of the ion source extraction pulse. However, this becomes increasingly difficult beyond a certain point. An alternative strategy is to reduce the extraction pulse amplitude but this will increase ion turnaround time and typically reduce the resolution of the instrument. Yet another option is to increase the flight energy of the ions in the analyzer and in this regard up to 20 kV is already commonly used. However, this diminishes the overall time-of-flight and therefore the instrument resolution. Moreover, very high applied voltages introduce cost, bulk and design complexity to an instrument.

In WO 2010/007373 A is disclosed a stigmatic imaging TOF mass spectrometer in which a potential gradient is applied to a spatial focusing lens correlated with ion arrival time for a limited range of masses to achieve good image focusing over the limited mass range. However, energy correction is not described.

In US 2013/0068944 A is described an approach to problems associated with injection of pulses of ions, e.g. from a MALDI source, into an ion trap mass analyzer such as an RF trap, FT-ICR trap or an electrostatic orbital trap such as an Orbitrap™ mass analyzer. There the problems are essentially related to the limitation on the mass range of ions that can be received from the pulsed source by the ion trap mass analyzer and trapped therein and the mass dependent spread of energies is relatively low, being typically only 5 eV/kDa, compared to the spread of energies typically associated with pulsed ion sources for TOF mass spectrometers. A series of cylindrical electrodes are provided downstream of the pulsed ion source on the axis along which the ions travel to which a time dependent potential is applied to change ion energies. For certain types of ion trap mass analyzer, the heavier ions are reduced in energy by the time dependent potential to improve trapping in the ion trap. In other embodiments, for example for injection into an orbital trap, the heavier ions arriving later are increased in energy in order to increase the mass range of ions that are trapped in the analyzer.

It is an aim of the invention to address the unequal average energy of ions of different masses when injected into a time-of-flight mass analyzer, which can result in reduced ion transmission and/or instrument resolving power, in particular for low mass ions, thus limiting instrument mass range.

SUMMARY OF THE INVENTION

According to an aspect of the present invention there is provided a mass spectrometer comprising:

a pulsed ion source for generating pulses of ions having a range of masses; a time-of-flight mass analyzer for receiving and mass analyzing the pulses of ions from the ion source; and an energy controlling electrode assembly located between the pulsed ion source and the time-of-flight mass analyzer configured to receive the pulses of ions from the pulsed ion source and apply a time-dependent potential to the ions thereby to control the energy of the ions depending on their m/z before they reach the time-of-flight mass analyzer.

According to another aspect of the present invention there is provided a method of time-of-flight mass spectrometry comprising:

generating a pulse of ions from a pulsed ion source;

receiving and mass analyzing the pulse of ions in a time-of-flight mass analyzer; and using an energy controlling electrode assembly located between the pulsed ion source and the time-of-flight mass analyzer to receive the pulses of ions from the pulsed ion source and apply a time-dependent potential to the ions thereby controlling the energy of the ions depending on their m/z before they reach the time-of-flight mass analyzer.

The term mass (or masses) generally refers to the mass-to-charge ratio (m/z). The invention is based on applying a varying potential synchronised to the arrival times of ions of different masses in order to correct a mass related energy perturbation of the ions. The ions extracted from the ion source have generally a range of masses (m/z). The time-dependent potential is preferably synchronised to the arrival times of ions of masses whose energy is to be changed, typically ions having a range of low masses (e.g. ions at the low mass end of the range of masses).

The invention enables differences in average energy of ions of different masses to be reduced for injection into a time-of-flight mass analyzer, which can improve ion transmission and/or instrument resolving power (resolution), in particular for low mass ions, especially for m/z less than 200.

The energy controlling electrode assembly is located downstream of the pulsed ion source. Generally, each pulse of ions generated by the ion source separates in space according to the m/z of the ions, i.e. so that they arrive at the electrode assembly in order of the m/z. In this way, lighter ions reach the electrode assembly before heavier ions. The applied potential lifts (or reduces) the energy of ions in the vicinity of the electrode assembly, but the application of the energy lift (or reduction) is time dependent and thereby the ion energies can be adjusted in a mass dependent manner. Thus, the timing and magnitude of the applied potential is preferably matched to the time-of-flight and/or energy deviation of the arriving ions (e.g. so that the timing and magnitude of the applied potential is depending on the energy deviation from the overall average energy of all ions). Therefore, a degree of time-of-flight separation of the ions occurs between the pulsed ion source and the downstream ion energy controlling electrode assembly.

The pulsed ion source can be a suitable pulsed on source known in the art. It can comprise, for example, an RF ion trap, a MALDI ion source, or an orthogonal accelerator (OA). In embodiments in which the pulsed ion source comprises an RF ion trap, the RF ion trap can be a 3D ion trap (Paul trap) or a linear ion trap, which can be a curved linear ion trap or a rectilinear ion trap. A curved linear ion trap herein may also be known as a C-trap and a rectilinear ion trap may also be known as an R-trap. The pulsed ion source can be held under vacuum, in a vacuum chamber. Typically, the pressure in the pulsed ion source (e.g. ion trap, MALDI source or OA) is not greater than $1\times10^{-2}$ mbar.

The time-of-flight (TOF) mass analyzer typically comprises a flight region, which the ions enter downstream of the pulsed ion source. The ions separate in the flight region according to the mass-to-charge ratio, m/z. The flight region contains the flight path of the ions. The flight path may be linear, or folded (e.g. due to one or more reflections of the ions, and in some embodiments may be zig-zag in nature), or of a race-track type (e.g. an oval or figure of 8 shape). The TOF mass analyzer further comprises an ion detector for detecting the ions after they have travelled along the flight path. When the ions reach the detector their times-of-flight are recorded. The times of flight of the ions are then typically converted to their m/z values. Thus, a mass spectrum of the ions is measured.

The TOF mass analyzer is typically located in a different vacuum region to the pulsed ion source and/or the electrode assembly.

In particular embodiments, the invention relates to high mass resolution time-of-flight mass spectrometry and/or multi-reflection time-of-flight mass spectrometry. The invention is particularly useful with time-of-flight mass spectrometers, especially multi-reflection time-of-flight mass spectrometers, having a mass resolving power (measured at m/z 200) of at least: 30,000, or 40,000, or 50,000, or 70,000, or 100,000. Long flight path lengths are generally preferable, as described below.

Herein, the terms "resolution" and "resolving power" are employed. The resolution is the difference in the mass to charge ratio m/z of two peaks Δm/z for which the two peaks can be separated in the mass spectrum. Accordingly, the resolving power R of the mass analyzer is defined for a peak having a mass to charge ratio m/z by the ratio:

$$R(m/z) = \frac{m/z}{\Delta m/z}$$

For this definition, the resolving power R assumes that two peaks should be separated at the half maximum height of a peak (the 50% criterion). Then, the resolution Δm/z is the FWHM (full width at half maximum) of the peak. Accordingly, the resolving power R of the mass analyzer is then given by:

$$R(m/z) = \frac{m/z}{FWHM}$$

The invention is particularly useful for correcting energies of ions for injection into a multi-reflection TOF (mr-TOF) mass analyzer to improve transmission and mass resolution. The invention is of benefit in particular for mr-TOF mass analyzers having a limited acceptance of ion energy ranges, so that ion energy related losses in transmission and resolution can be better controlled. The invention is of benefit in particular for mr-TOF mass analyzers in which the range, i.e. spread, of kinetic energy of the ions injected into the analyzer is required to be 100 eV or less (FWHM), ideally 0 eV.

The mr-TOF mass analyzer may comprise an extended flight path, wherein two ion mirrors oppose each other in a direction X and both mirrors are generally elongated in a drift direction Y, orthogonal to direction X. Ions injected into the spectrometer are repeatedly reflected back and forth in the X direction between the mirrors, whilst they drift down the Y direction of mirror elongation. Overall, the ion motion follows a zigzag path. The invention is particularly useful for correcting energies of ions for injection into a mr-TOF mass analyzer as described in US2015/0028197 A and US 2015/0028198 A. This type of mr-TOF mass analyzer has an extended flight path wherein two ion mirrors oppose each other in a direction X and both mirrors are generally elongated in a drift direction Y, orthogonal to direction X. Ions injected into the spectrometer are repeatedly reflected back and forth in the X direction between the mirrors, whilst they drift down the Y direction of mirror elongation. Overall, the ion motion follows a zigzag path. The mirrors have a convergence with increasing Y, thereby creating a pseudo-potential gradient along the Y axis that acts as an ion mirror to reverse the ion drift velocity along Y. The ions are then spatially focussed in Y to a focal point where a detector is placed, typically near to the region of ion injection.

Preferably, the TOF or mr-TOF mass spectrometer has a total flight path length for the ions, i.e. measured between the pulsed ion source and the detector, of at least 10 metres or 15 metres, more preferably at least 20 metres and most preferably at least 30 metres. A path length of 10-30 metres, or 15-20 metres, or 20-30 metres is thus preferred.

In addition to multi-reflection TOF mass spectrometers, the invention can be used for introducing ions into other types of TOF mass spectrometers, for example those having a 'race-track' configuration, wherein the ions can travel around the 'race track' flight path multiple times to extend their total flight time.

It will be appreciated that other ion optical components may be present in the ion path between the source and the detector. For example, one or more lenses can be provided immediately after the ion source (extraction trap) to limit expansion of the ions.

The energy controlling electrode assembly is provided to control the energy, i.e. the kinetic energy, of the ions depending on their m/z. The ion energy controlling electrode assembly is located downstream of the pulsed ion source for receiving the pulses of ions from the pulsed ion source and upstream of the time-of-flight mass analyzer, i.e. electrode assembly is located between the pulsed ion source and the time-of-flight mass analyzer. The energy of ions that have traversed the ion energy controlling electrode assembly may therefore be controlled before they enter the time-of-flight mass analyzer.

The energy controlling electrode assembly is typically located in close proximity to the pulsed ion source, compared to the total length of the ion flight path in the spectrometer. For example, in some preferred embodiments, the length of the ion flight path in the flight region may be 1-30 metres and the ion energy controlling electrode assembly may be located less than 10 mm downstream from an extraction electrode of the pulsed ion source. Preferably, the energy controlling electrode assembly is located downstream from the pulsed ion source at a distance that is less than 1% of the length of the total ion flight path between the pulsed ion source and the detector, or in some embodiments is less than 0.5%, or less than 0.2% or less than 0.1%, of the length of the total ion flight path between the pulsed ion source and the detector. The energy controlling electrode assembly is typically located at the first time focal plane of the ions.

The electrode assembly is configured to apply a dynamic (time-dependent) potential to the ions passing through it. Thus, the ions experience a time-dependent potential gradient as they pass through the electrode assembly. In some embodiments, a time-dependent voltage is applied to one or more electrodes of the electrode assembly to provide the time-dependent potential gradient. In certain embodiments, a first voltage is applied to one or more first electrodes of the electrode assembly and a second voltage is applied to one or more second electrodes of the electrode assembly.

For positive ions, the time-dependent voltage(s) applied to the electrode assembly is preferably a positive voltage. In such embodiments, the (or each) time-dependent voltage(s) more preferably increases from a less positive voltage to a more positive voltage with increasing time (i.e. increasing arrival time). For negative ions, the polarities would preferably be reversed, i.e. the time-dependent voltage(s) applied to the electrode assembly in that case would be preferably a negative voltage. In such embodiments, the (or each) time-dependent voltage(s) more preferably increases from a less negative voltage to a more negative voltage with increasing time (i.e. increasing arrival time).

The energy spread is mass dependent. Typically, ions of low mass, e.g. mass less than 200 m/z (or Da), have a lower energy than ions of relatively higher mass, e.g. mass greater than 200 m/z. The initial mass-dependent energy spread of the ions (before correction), e.g. among lower mass ions that deviate from the average energy of the higher mass ions, may be in the range 0.1 V/Da to about 2 V/Da, in particular 0.2 V/Da to 1.5 V/Da. In certain preferred embodiments, the energy of lighter ions is lifted to substantially the same energy as the energy of the heavier ions. In some particular embodiments, the energy of at least some ions having m/z less than 200, or having m/z less than 150, or having m/z less than 100, is lifted. In some particular embodiments, the energy of the lighter ions, e.g. having m/z less than 200, is lifted to substantially the same energy as ions having m/z greater than 200. In some embodiments, at least some of the ions, for example having m/z less than 200 (or having m/z less than 150, or having m/z less than 100), are lifted in energy by at least 10 eV, or at least 20 eV, or at least 30 eV, or at least 40 eV, or at least 50 eV.

The energy controlling electrode assembly is controlled so as to apply the time-dependent potential to the ions depending on their arrival time at the assembly (which depends on the m/z of the ions) thereby to control the energy of the ions depending on their m/z. Thus, the time-dependent potential does not vary periodically. Rather, the time-dependent potential varies depending on the arrival time of at least some of the ions in the pulse of ions from the ion source.

The ions entering and exiting from the energy controlling electrode assembly typically form an ion beam. In certain preferred embodiments, the energy controlling electrode assembly is additionally for shaping the ion beam. In such embodiments, for shaping the ion beam, the energy controlling electrode assembly is preferably located close to the pulsed ion source (for example, at a distance from the pulsed ion source that is less than 1%, or less than 0.5%, or less than 0.2% or less than 0.1%, of the length of the total ion flight path between the pulsed ion source and the detector as described above).

The energy controlling electrode assembly may comprise at least one electrode to which a time-dependent voltage is applied (herein a so-called dynamic electrode). The voltage (s) is typically applied to the at least one dynamic electrode from a power supply under the control of a controller.

The energy controlling electrode assembly may comprise or consist of a plate, i.e. planar, electrode having an aperture therein for receiving and transmitting the ions, i.e. the ions pass through the aperture as they travel between the ion source and the mass analyzer. The plate or planar electrode acts as a dynamic electrode, i.e. to which a time-dependent voltage is applied. The plate or planar electrode is preferably oriented in a plane that is substantially orthogonal to the direction of travel of the ions, which includes an embodiment of the plate or planar electrode being oriented in a plane that is essentially orthogonal to the direction of travel of the ions. The aperture can be of suitable shape and dimensions so as to permit transmission of substantially all of the ions. The aperture can be for example, circular, or elliptical, or rectangular (optionally square) in shape. Preferably, the aperture is in the form of a slot (i.e. substantially rectangular or letterbox shape). In this way, the aperture accepts the elliptical or letterbox shape of the ion beam (cross-sectional shape transverse to direction of beam travel). The height of the aperture typically is greater than the height of the beam. The height of the aperture or beam is generally the smaller dimension and the width of the aperture or beam is generally the larger dimension, i.e. the width dimension is generally greater than the height. Preferably, the height and width of the aperture (e.g. slot) in the plate or planar electrode are greater than the thickness of the plate or planar electrode (the thickness being the dimension of the electrode in the direction of ion travel, the height and width being in the plane orthogonal to the direction of ion travel). For example, in one embodiment, the plate or planar electrode of the energy controlling electrode assembly can be 1 mm thickness and have a 4 mm height slot aperture for the ions, together with a width greater than 4 mm.

Instead of comprising a single plate electrode having an aperture or slot, the energy controlling electrode assembly could be constructed as two plate electrodes with a gap therebetween between, which can act in the manner of the aperture described. However, this is generally considered to be less preferable as the accuracy of the gap is harder to maintain.

A plate electrode has several advantages over, for example, a tube electrode design. As space is typically very limited immediately in front of the ion source (where this dynamic electrode is preferably located to minimize time of flight aberrations) due to differential pumping and lensing requirements, a thin electrode is advantageous for control of the ion cloud size and for not blocking pumping as, for example, a tube would.

The energy controlling electrode assembly, especially the dynamic electrode thereof, is preferably located at an isochronous plane, most preferably the first time focal plane (as the beam travels from the ion source). Otherwise, ions with the same m/z will be given additional energy dispersion instead of reducing their energy dispersion, thereby leading to deterioration in subsequent time of flight focii.

At least one lower potential electrode (lower potential relative to the pulsed ion source and/or the energy correcting electrode assembly) is preferably provided downstream (in the ion path) of the dynamic electrode but upstream of the TOF mass analyzer. The at least one lower potential electrode is in certain preferred embodiments a ground electrode (i.e. at ground or earth potential) provided downstream of the dynamic electrode but upstream of the TOF mass analyzer. In some embodiments, the ion source (for example ion trap) may be floated at a potential of several kV (e.g. 3-5 kV) and the ions move from this potential to a ground final potential. In a preferred example, the average flight energy of the ions is defined by the potential (e.g. 4 KV) of the pulsed ion source relative to a ground electrode (i.e. the lower potential electrode is a ground electrode). However, in another example, the same average flight energy of the ions could be defined by a grounded ion source (excepting push/pull voltages for ion extraction), with one or more other voltages downstream in the ion path, including that of the lower potential electrode, offset to −4 KV. The ions preferably pass through the lower potential (e.g. ground) electrode in the ion path. Thus, more generally, the potential on the lower potential electrode relative to the higher potential of the ion source defines the ion energy (excluding any so-called post acceleration of the ions which may be applied before the ions strike the detector, wherein the detector is an ion impact detector, such as a multi-channel plate). The lower potential or ground electrode is a static electrode (i.e. constant earth potential) in contrast to the dynamic electrode for energy adjustment. The distance between the lower potential or ground electrode and the dynamic electrode is preferably greater than the distance between the dynamic electrode and the pulsed ion source. Typically, the distance between the lower potential or ground electrode and the dynamic electrode is at least 1.5×, or at least 2×, or at least 3× (e.g. 4×) the distance between the dynamic electrode and the pulsed ion source.

The applied time-dependent potential (potential lift) is typically linear, but does not need to be linear, with respect to time. Indeed, an applied non-linear time-dependent voltage (e.g. pseudo-exponential) where the voltage gradient diminishes with time would be ideal to match the initial mass related energy perturbation of the ions. However, it is typically simpler to implement a linear or an approximately linear voltage ramp, which can be achieved by a single electronic switch between two voltage levels (one of which may be ground) and an appropriate RC time constant to control the rate of change of voltage on an electrode. The most preferable practical embodiment comprises a single energy controlling electrode (dynamic electrode), with a linear voltage ramp applied to it, e.g. either between two high voltages and starting at the moment of ion extraction from the pulsed ion source, or between ground and a high voltage, in which case it is preferable to employ a suitable delay between the start of the voltage ramp and moment of extraction from the ion source (i.e. the ramp starts before the ion extraction from the pulsed ion source as it takes longer to reach the high voltage from ground potential).

The time-dependent voltage thus preferably comprises a voltage ramp that changes the voltage from a first voltage (the voltage on the dynamic, energy controlling electrode at the moment of ion extraction) to a second voltage. The range (i.e. magnitude) of the voltage ramp (difference between start (first) and end voltages) may be between100-1000V, preferably, 200-800V, more preferably 300-700V or 400-700V (e.g. a ramp with a magnitude of 500V or a ramp with a magnitude of 600V). Preferably, the magnitude of the voltage ramp should be similar to (in some embodiments substantially the same as) the magnitude of required energy correction, e.g. several hundred eV (such as 100-1000V etc.). The range or magnitude of the voltage ramp herein is defined as the range from the voltage at the point or moment of the ion extraction from the pulsed source (first voltage) to the end voltage (second voltage). If the voltage starts from ground, then it may be scanned through a higher overall range (when measured from before the ion extraction from the source), e.g. 1200V or more, however the start of the ramp in that case precedes the ion extraction from the ion source. Nevertheless, the range or magnitude of the ramp from the voltage at the point or moment of the ion extraction from the pulsed source (first voltage) to the end voltage preferably is 100-1000V, 200-800V, 300-700V or 400-700V as described. For example, an optimum end voltage to the ramp in one embodiment with a 4 kV flight energy, such as created by a 4 kV floating ion trap as ion source and downstream ground electrode(s), is +1240V, so the voltage scan, starting at the point of ion extraction from the source, can be, e.g. 690-1240V. Since with a suitable delay to the ion extraction it is possible to start at ground then the overall voltage scan (when measured from before the ion extraction from the source) can be from 0-1240 V. In another embodiment, where the ion trap is grounded and downstream electrode(s) is −4 KV, the two voltages at the start and end of the ramp would be 4 kV offset compared to the preceding embodiment, i.e. −3310V and −2760V respectively.

The rate of change of the time dependent voltage during the ramp may be from 0.01 to 100 V/ns (volts per nanosecond), preferably from 0.1 V/ns to 10 V/ns, more preferably from 0.5 V/ns to 5 V/ns, or especially from 1 V/ns to 5 V/ns. The first voltage at the beginning of the ramp may be ground potential, or a voltage up to 1000V. The second voltage at the end of the ramp may be a voltage greater than 500V, greater than 750V or more preferably greater than 1000V. Preferably, the first voltage is between 0-1000V, or 10-1000V (especially 100-1000V) and the second voltage is greater than 1000V (for example between 1000-2000V, or 1000-1500V).

After the voltage ramp has reached the second value, the voltage applied to the energy controlling electrode is maintained at the second value (e.g. >500V, or preferably >1000V). The correcting electrode preferably serves an additional purpose of shaping the extracted ion beam.

It some embodiments, the pulsed extraction voltage applied to the pulsed ion source may cause a noticeable ripple or ringing on the energy throughout the mass range. It is possible that further ringing may be caused from other parts of the electronic design (residual RF for example). Typically, such ringing will have an oscillation period similar to the rise time of the extraction pulse (100 s of ns) and generally decay over several oscillations. In certain embodiments, therefore, such ringing effects may be corrected by applying a ripple or oscillation voltage to the energy controlling electrode assembly (i.e. superimposed on the voltage ramp), wherein typically only a few oscillations are needed to be applied.

In certain advantageous embodiments, the energy control of the ions does not need to be accomplished all in one stage (i.e. in one stage of time and/or at one energy controlling electrode assembly). On the contrary, in some embodiments, several energy adjusting stages may be applied, e.g. at different times and/or on different energy controlling electrode assemblies.

A voltage controller is typically provided for controlling the time-dependent voltage(s) applied to the energy controlling electrode assembly from a power supply. The controller typically comprises a computer. The computer is preferably operable to execute a program that includes instructions for performing the method of mass spectrometry in accordance with the present invention. The program may be embodied in software or firmware.

DETAILED DESCRIPTION

The present invention will now be described in more detail by way of the following embodiments and with reference to the accompanying figures.

Figure 1:
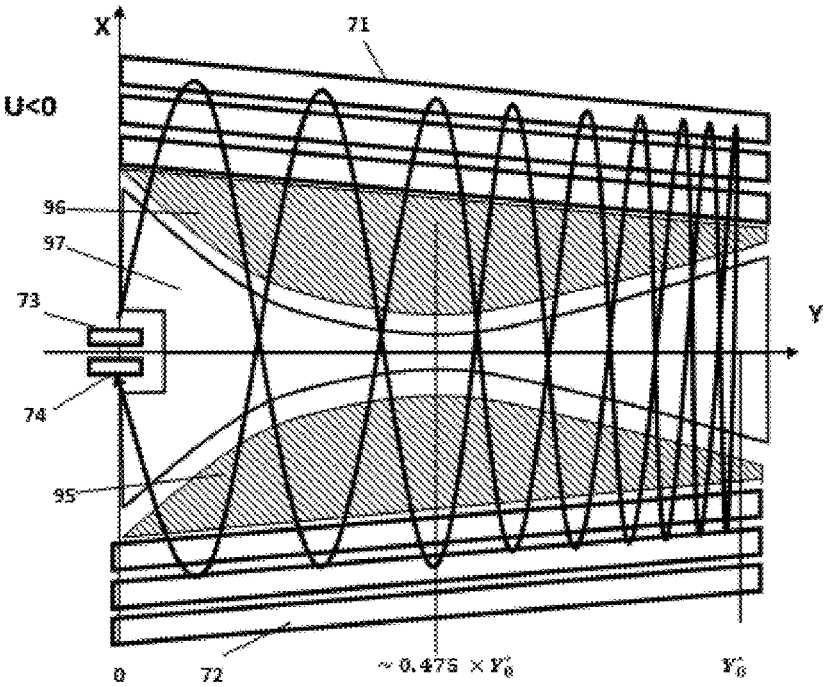
Fig. 1 (Prior Art)
FIG. 1 shows schematically a plan view of an embodiment of a time of fight mass analyzer.
Figure 2:
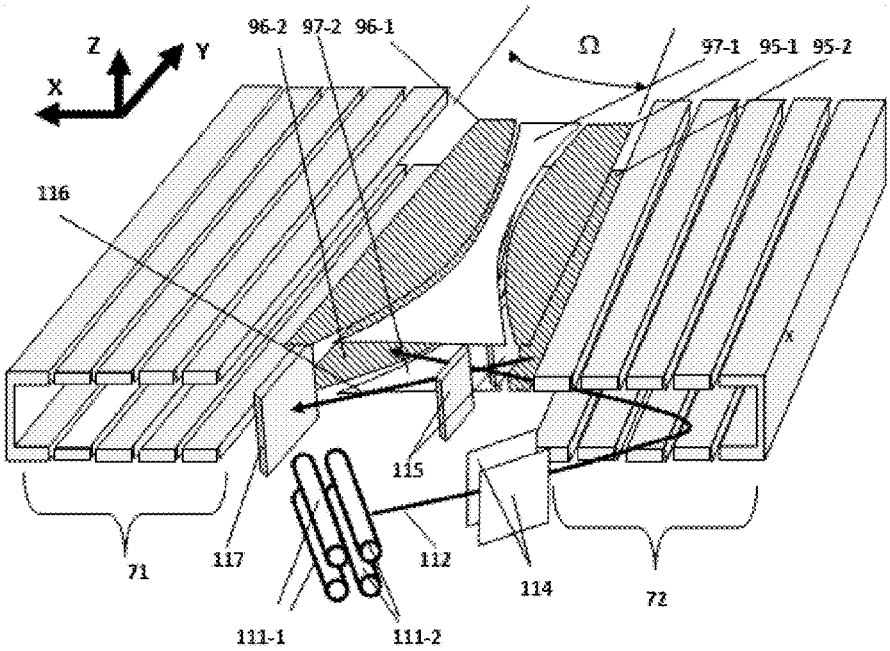
Fig. 2 (Prior Art)
FIG. 2 shows schematically a perspective view of another embodiment of a time of fight mass analyzer.

FIGS. 1 and 2 show schematically embodiments of multi-reflection time of flight mass spectrometers. The designs are described in detail in US 2015/028197 A (the contents of which is hereby incorporated by reference in its entirety).

As the designs are similar they will be described together for simplicity. The multi-reflection time-of-flight (mr-ToF) analyzers are constructed around two opposing ion mirrors, 71 and 72, generally elongated in a drift direction Y. A pulsed ion source 73 such as an extraction trap having quadrupole rods 111-1 and 111-2, injects ions into the first mirror 72 and the ions then oscillate between the mirrors. The ion beam is shaped by lenses (not shown) after leaving the extraction trap before being deflected by first and second deflectors 114 and 115 respectively. The angle of the extraction trap and additional deflectors, 114 and 115, allow control of the energy of the ions in the drift direction Y, such that ions are directed down the length of the mirrors as they oscillate, producing a zig-zag trajectory. The mirrors themselves are tilted relative to one another, producing a potential gradient that retards the ions' drift velocity (in the Y direction) and causes them to be reflected backwards in the drift direction and focused onto a detector 74, 117. The tilting of the opposing mirrors 71, 72 would normally have the negative side-effect of changing the time period of ion oscillations as they travel down the drift dimension. This is corrected with compensation electrodes 95, 96, 97, located in the space between the mirrors above and below the ion beam, that alter the flight potential for a portion of the inter-mirror space, varying down the length of the opposing mirrors. The combination of the varying width of the compensation electrodes and variation of the distance between the mirrors allows the reflection and spatial focusing of ions onto the detector 74, 117 as well as maintaining a good time focus. The design is advantageous in providing a high mass resolution by virtue of having a long, folded ion path, which may be over 25m in length (distance travelled by ions from ion source to detector).

Generally, the only part of the mr-ToF analyzer that requires to be dynamically controlled is the pulsed ion source, i.e. the extraction trap in these embodiments, as it has dynamic voltages to trap ions and subsequently to inject them into the analyzer. All other voltages are static during normal instrument operation.

Although, a specific mr-ToF design is shown in FIGS. 1 and 2, it will be understood that the invention is applicable to other designs of time of flight mass analyzer.

The pulsed ion source shown is an RF linear ion trap containing some buffer gas, such as argon for example, at pressures typically of $5\times10^{-4}$ to $1\times10^{-2}$ mbar. The trap has the ability to quickly switch off RF and apply voltages to extract the trapped ions. The so-called C-Trap, a curved linear ion trap, is one example of a suitable extraction trap for a pulsed ion source.

An extraction trap, in the form of either a linear or 3D ion trap, is not the only possible ion source for the mr-ToF. In principle, a more traditional orthogonal accelerator as found in standard commercial ToF instruments may be used, or a MALDI ion source may be used.

A preferred ion source for the mr-ToF embodiments shown is a similar linear trap but constructed of flat plates (a so-called rectilinear trap or R-Trap). There is description of the R-trap and extraction method in U.S. Pat. No. 9,548,195 (B2) (the contents of which is hereby incorporated by reference in its entirety).

Figure 3:
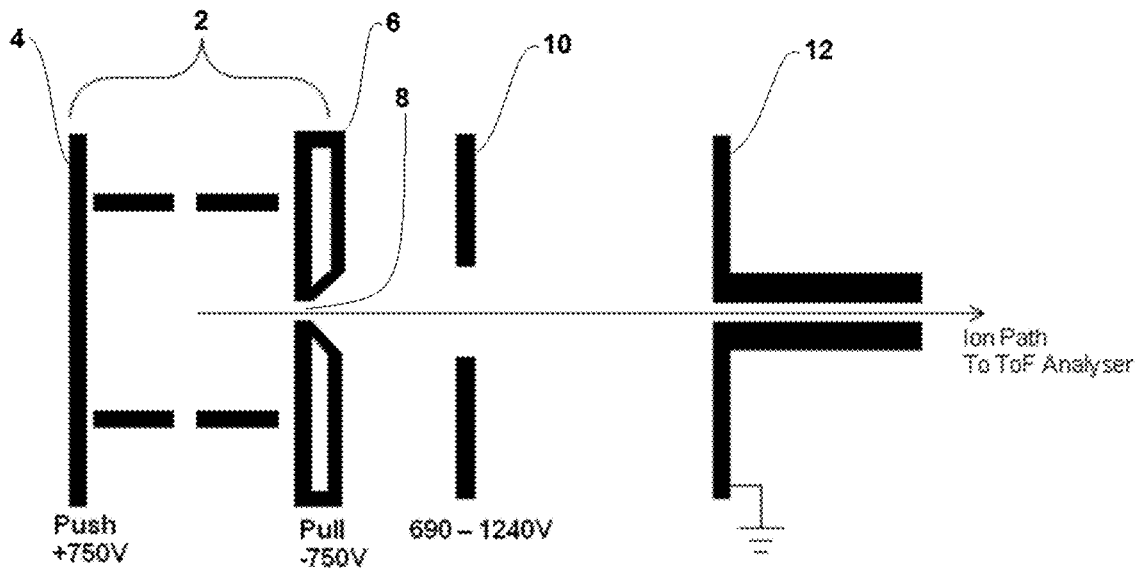
FIG. 3 shows schematically a rectilinear trap pulsed ion source together with an ion optical arrangement comprising an energy controlling electrode assembly in accordance with the present invention.

Referring to FIG. 3, there is shown more detail of a rectilinear trap pulsed ion source together with an ion optical arrangement comprising an energy controlling electrode assembly in accordance with the present invention.

Ions are extracted from a rectilinear ion trap 2 having a 2 mm inscribed radius, with a 4 KV applied DC potential. A trapping RF voltage (1 KV peak-to-peak) is applied, which is quenched before extraction and ±750V (relative to the 4 KV) is applied to "push" and "pull" electrodes 4 and 6 above and below the centre of the trap (in the ion flight direction), thereby creating a strong field gradient and accelerating ions out of a 0.6 mm×8 mm slot 8 in the "pull electrode" 6, the slot being elongated in the direction of the trap length. In this example the extraction potential has a 100 ns (nanosecond) rise time.

An energy controlling electrode 10, which may also be termed an energy correcting electrode, comprising a metal plate 1 mm thick provided with a 4 mm high slot, is located 2 mm downstream from the 2 mm thick pull electrode (the thickness of the plate and height of the slot being shown in the plane of the page). The slot width in the dimension perpendicular to the page is greater than its height and accommodates substantially the full width of the ion beam. Alternatively to a metal plate, a non-metallic plate having a metallic coating may be used as the energy controlling electrode. The plate electrode is planar and oriented in a plane that is substantially orthogonal to the direction of travel of the ions as shown by the arrow.

In use, for energy correction, a voltage ramp can be applied to the electrode 10, which starts with +690 V applied at the point of extraction and ramps linearly to +1240V after 245 nanoseconds. After this 245 ns rise period a constant +1240 V is applied. The correcting electrode 10 serves an additional purpose of shaping the extracted ion beam, with +1240V being the optimum value. Ions extracted from the pull electrode accelerate through the voltage gradient between the two electrodes, and then further accelerate to their full 4 KV flight potential as they enter a 1 mm to 2 mm slot of a grounded electrode 12 located a further 8 mm downstream from the correcting electrode 10. The grounded electrode enables bringing the ions up to their flight energy of 4 KV. Thereafter, the ions enter the time of flight mass analyzer (optionally after one or more stages of deflection to align the ion beam). The grounded electrode may be a thin plate with an entrance slot, preferably followed by a deflector region. The entrance slot is preferably relatively small (e.g. 2 mm high×12 mm wide), typically smaller in cross sectional area than the aperture in the energy correcting electrode, to reduce gas leakage into the time of flight mass analyzer which lies downstream. The deflector region preferably includes at least one ion deflector to provide a desired injection angle for the ions into the ToF analyzer.

Figure 4:
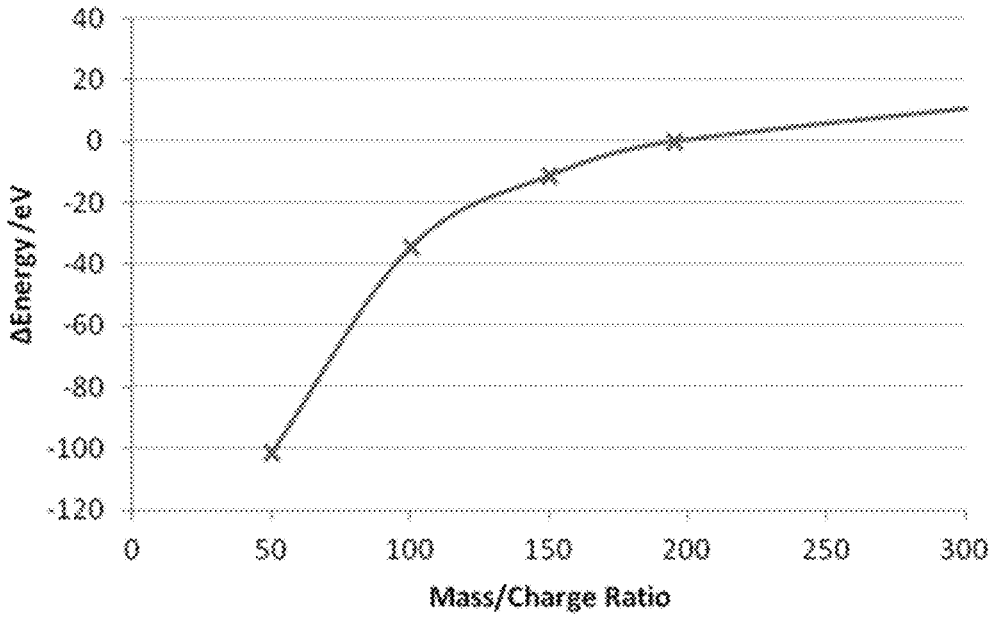
FIG. 4 shows the simulated energy deviation of ions relative to a reference ion, caffeine (m/z=195), from the ion source shown in FIG. 3.
Figure 5:
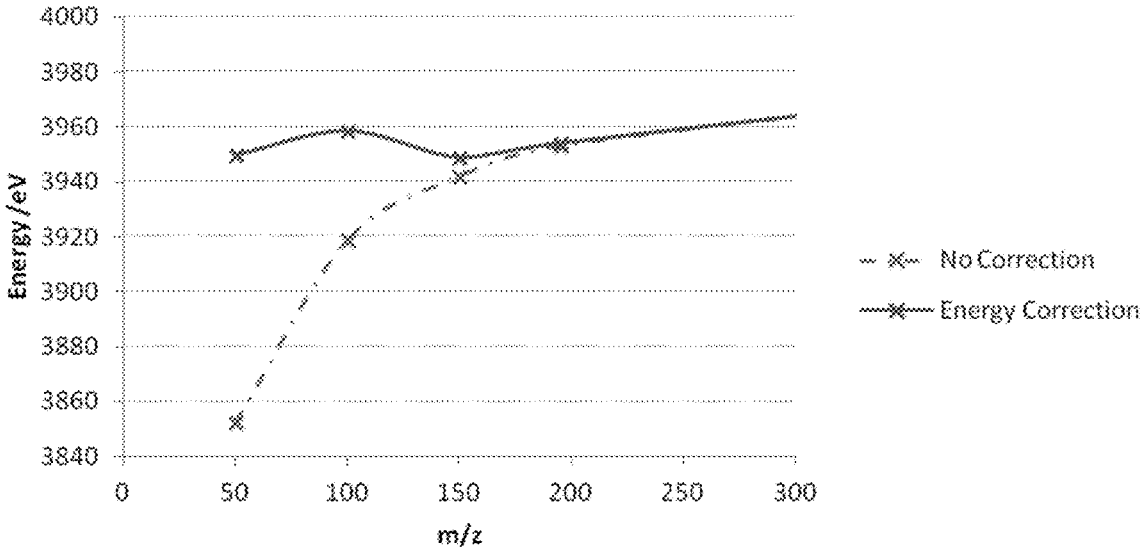
FIG. 5 shows the energy correction for ions using the energy controlling electrode assembly in accordance with the present invention shown in FIG. 3.
Figure 6:
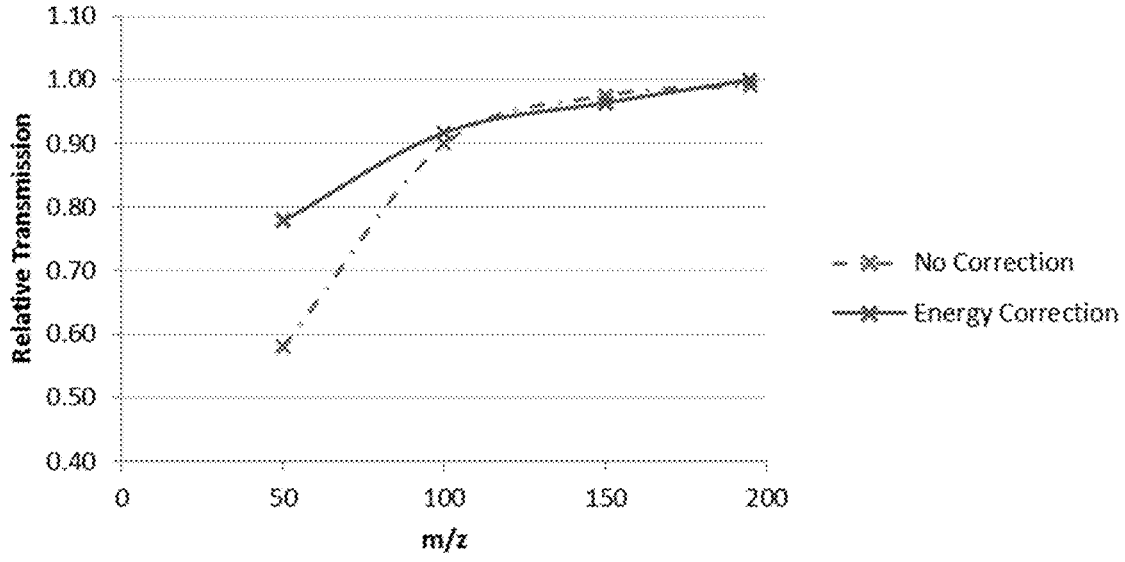
FIG. 6 shows the simulated relative ion transmission in a time-of-flight mass analyzer, with and without ion energy correction in accordance with the invention.
Figure 7:
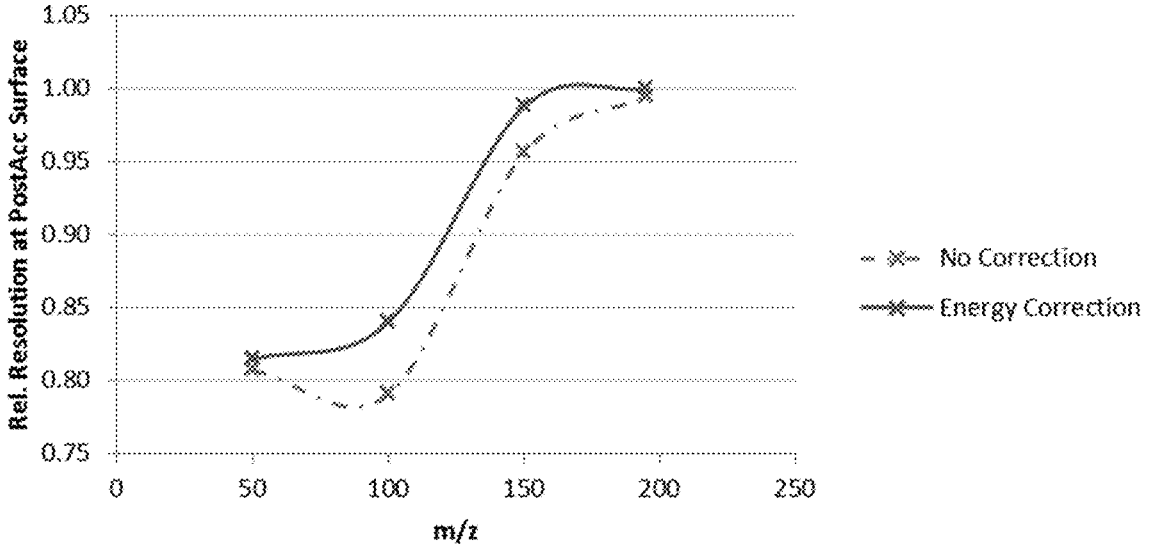
FIG. 7 shows the simulated relative resolving power of a time-of-flight mass analyzer, with and without ion energy correction in accordance with the invention.

FIG. 4 shows the simulated energy deviation of ions relative to a reference ion, caffeine (m/z=195), from the ion trap source with 2 mm inscribed radius and 100 ns rise time on a 375 V/mm extraction field. The invention provides the solution of applying a voltage gradient (vs time) to the correcting electrode located down the ion flight path from the ion source. A simulation based on the above described electrode assembly and voltages was made and ion energies (relative to m/z=195) at different masses measured with and without the applied voltage gradient on the energy correcting electrode 10. The 550V voltage ramp with 245 ns rise time applied to the energy correcting electrode was demonstrated to remove much of the energy perturbation from ions m/z=50–150 as shown in FIG. 5. Further simulation of a full time of flight mass analyzer incorporating the above described ion source and ion optical arrangement showed a substantial reduction in mass related transmission losses (see FIG. 6) together with an improvement in resolving power (see FIG. 7). Correspondingly, the mass range of the instrument can also be extended.

It will be appreciated that the invention may be implemented in numerous variants of the above described embodiments. The example above uses a single energy controlling electrode positioned immediately after, i.e. in front of, the pulsed ion trap so that the energy controlling electrode assembly also serves as a spatial focusing device or lens, but the energy controlling electrode assembly could be incorporated somewhere further down the ion path where there is space to include the ion optical arrangement for the purpose of energy adjustment. More preferably, the energy correcting electrode should be located at or near an isochronous plane, and most preferably at the first time focus or focal plane (which lies before the ToF analyzer), as otherwise ions at different m/z will be poorly separated in space, giving ions with the same m/z an additional energy dispersion, shifting and distorting the subsequent ToF focii. In a preferred embodiment, therefore, the energy correcting electrode assembly is located at or near an isochronous focal plane upstream of the ToF analyzer, especially the first isochronous focal plane. The assembly may even be included within the time-of-flight analyzer itself, although this is disadvantageous compared to locating it at or near the first time focus or focal plane, upstream of the ToF analyzer.

The energy controlling electrode assembly need not be provided or activated in one stage, i.e. a plurality of energy adjusting stages may be provided. The plurality of energy adjusting stages may be provided at different times (e.g. one energy controlling electrode assembly operated at different times) and/or at different locations, i.e. at different energy controlling electrode assemblies.

The applied potential lift, i.e. voltage ramp, need not be linear with respect to time. In fact, a non-linear voltage lift wherein a voltage gradient diminishes with time would typically be better to match the initial mass related energy perturbation of the ions. It is, however, much simpler to implement a linear or an approximately linear voltage ramp, which can be achieved by using a single electronic switch between two voltage levels (e.g. one of which may be ground) and an RC circuit with an appropriate RC time constant to control the rate of change of voltage on an electrode. The most preferable practical embodiment would be to have a single correction electrode, with a linear voltage ramp. The voltage ramp may be either between two high voltages and starting at the point of time of ion extraction from the ion source (e.g. when the extraction pulse is applied), or between ground and a high voltage with a suitable delay between the start of the voltage ramp and the point of extraction (i.e. the correction ramp starts before the ion extraction).

The invention allows an improvement in the transmission and resolution of time-of-flight instruments, particularly in advanced time-of-flight designs that may have a more limited acceptance of ion energy ranges, since the invention can ensure that ion energy related losses in transmission and resolution are better controlled. The invention is especially useful for time-of-flight mass spectrometers requiring a range (spread) of ion energies that is less than 5%, or less than 3% of the average energy of the ions (e.g. 200 eV or less, or 100 eV or less, for a 4 kV flight energy of ions).

As an alternative to the multi-reflection time of flight (mr-TOF) mass analyzer shown in FIGS. 1 and 2, the present invention may comprise another type of time of flight mass analyzer. A linear TOF mass analyzer could be used. A "racetrack" type of TOF mass analyzer could be used (e.g. with an oval or figure of eight ion beam path). However, a mr-TOF mass analyzer is preferably used. Other types of mr-TOF mass analyzer that could be used may include, for example, one of the following types:

A mr-TOF mass analyzer comprising an arrangement of two parallel opposing mirrors, as described by Nazarenko et. al. in patent SU1725289. In such embodiments, the mirrors are elongated in a drift direction and ions followed a zigzag flight path, reflecting between the mirrors and at the same time drifting relatively slowly along the extended length of the mirrors in the drift direction. Each mirror can be made of parallel bar electrodes.

A mr-TOF mass analyzer comprising parallel opposing gridless ion mirrors, for example as described by Wollnik in GB patent 2080021. Two rows of mirrors in a linear arrangement or two opposing rings of mirrors can be arranged. Some of the mirrors may be tilted to effect beam injection.

A mr-TOF mass analyzer comprising a gridded parallel plate mirror arrangement elongated in a drift direction, as described by Su in International Journal of Mass Spectrometry and Ion Processes, 88 (1989) 21-28. The opposing ion reflectors can be arranged to be parallel to each other and ions follow a zigzag flight path for a number of reflections before reaching a detector.

A mr-TOF mass analyzer comprising periodically spaced lenses located within a field free region between two parallel elongated opposing mirrors as described by Verentchikov in WO2005/001878 and GB2403063. The purpose of the lenses is to control the beam divergence in the drift direction after each reflection, thereby enabling a longer flight path to be obtained.

A mr-TOF mass analyzer comprising a system for beam focusing in the drift direction for a multi-reflection elongated TOF mirror analyzer, as described by Makarov et al in WO2009/081143. In such embodiments, a first gridless elongated mirror is opposed by a set of individual gridless mirrors elongated in a perpendicular direction, set side by side along the drift direction parallel to the first elongated mirror. The individual mirrors provide beam focusing in the drift direction.

A mr-TOF mass analyzer comprising a system for beam focusing in the drift direction comprising elongated parallel opposing mirrors as described by Verentchikov and Yavor in WO2010/008386. In this arrangement, periodic lenses are introduced into one or both the opposing mirrors by periodically modulating the electric field within one or both the mirrors at set spacings along the elongated mirror structures.

A mr-TOF mass analyzer as described by Ristroph et al in US2011/0168880 comprising opposing elongated ion mirrors that comprise mirror unit cells, each having curved sections to provide focusing in the drift direction and to compensate partially or fully for a second order time-of-flight aberration with respect to the drift direction.

A mr-TOF mass analyzer comprising two parallel gridless mirrors and further comprising a third mirror oriented perpendicularly to the opposing mirrors and located at the distal end of the opposing mirrors from the ion injector as described by Sudakov in WO2008/047891.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to" and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

The invention claimed is:

1. A mass spectrometer comprising:

a pulsed ion source for generating pulses of ions having a range of masses;

a time-of-flight mass analyzer for receiving and mass analyzing the pulses of ions from the ion source; and an energy controlling electrode assembly, located between the pulsed ion source and the time-of-flight mass analyzer at an isochronous plane, configured to receive the pulses of ions from the pulsed ion source and apply a time-dependent potential to the ions thereby to control the energy of the ions depending on their m/z before they reach the time-of-flight mass analyzer.

2. The mass spectrometer of claim 1, wherein the time-dependent potential is synchronised to the arrival times of ions whose energy is to be changed.

3. The mass spectrometer of claim 2, wherein the ions whose energy is to be changed are ions at the low mass end of the range of masses.

4. The mass spectrometer of claim 3, wherein the time-dependent potential lifts the energy of the ions at the low mass end of the range of masses.

5. The mass spectrometer of claim 1, wherein the pulsed ion source comprises an RF ion trap.

6. The mass spectrometer of claim 1, wherein the time-of-flight mass analyzer is a multi-reflection time-of-flight mass analyzer having a mass resolving power of at least 30,000.

7. The mass spectrometer of claim 6, wherein a total flight path length of the ions is at least 10 metres.

8. The mass spectrometer of claim 1, wherein the time-of-flight mass analyzer comprises two ion mirrors opposing each other in a direction X and both mirrors are generally elongated in a drift direction Y, orthogonal to direction X, wherein ions injected into the spectrometer are repeatedly reflected back and forth in the X direction between the mirrors whilst they drift down the Y direction of mirror elongation, the mirrors having a convergence with increasing Y, thereby creating a pseudo-potential gradient along the Y axis that acts as an ion mirror to reverse the ion drift velocity along Y.

9. The mass spectrometer of claim 1, wherein the energy controlling electrode assembly is located at a first time focal plane of the ions downstream of the ion source.

10. The mass spectrometer of claim 1, wherein the energy controlling electrode assembly comprises a planar electrode oriented in a plane that is substantially orthogonal to the direction of travel of the ions and having an aperture therein through which the ions pass.

11. The mass spectrometer of claim 1, further comprising an electrode of lower potential than the pulsed ion source downstream of the energy controlling electrode assembly through which the ions pass.

12. The mass spectrometer of claim 11, wherein the electrode of lower potential through which the ions pass is a ground electrode.

13. The mass spectrometer of claim 1, wherein the time-dependent potential is a substantially linear voltage ramp.

14. The mass spectrometer of claim 13, wherein the magnitude of the voltage ramp is 100-1000V.

15. The mass spectrometer of claim 13, wherein a rate of change of the time dependent voltage during the voltage ramp is from 0.1 V/ns to 10 V/ns.

16. The mass spectrometer of claim 1, wherein the time-dependent potential is a non-linear voltage ramp.

17. A method of time-of-flight mass spectrometry comprising:

generating a pulse of ions from a pulsed ion source;

receiving and mass analyzing the pulse of ions in a time-of-flight mass analyzer; and using an energy controlling electrode assembly located between the pulsed ion source and the time-of-flight mass analyzer at an isochronous plane to receive the pulses of ions from the pulsed ion source and apply a time-dependent potential to the ions thereby controlling the energy of the ions depending on their m/z before they reach the time-of-flight mass analyzer.

18. The method of claim 17, wherein the time-dependent potential is synchronised to the arrival times of ions whose energy is to be changed.

19. The method of claim 18, wherein the ions whose energy is to be changed are ions at the low mass end of the range of masses.

20. The method of claim 19, wherein the ions have a mass-to-charge ratio less than 200.

21. The method of claim 18, wherein the time-dependent potential lifts the energy of the ions at the low mass end of the range of masses.

22. The method of claim 17, wherein the energy controlling electrode assembly is located in close proximity to the pulsed ion source.

23. The method of claim 17, wherein the time-of-flight mass analyzer is a multi-reflection time-of-flight mass analyzer having a mass resolving power of at least 30,000 and a total flight path length of the ions is at least 20 metres.

24. The method of claim 17, wherein the energy controlling electrode assembly comprises a planar electrode oriented in a plane that is substantially orthogonal to the direction of travel of the ions and having an aperture therein through which the ions pass.

25. The method of claim 17, further comprising an electrode of lower potential then the pulsed ion source downstream of the energy controlling electrode assembly through which the ions pass.

26. The method of claim 25, wherein the electrode of lower potential through which the ions pass is a ground electrode.

27. The method of claim 17, wherein the time-dependent potential is a substantially linear voltage ramp.

28. The method of claim 27, wherein the magnitude of the voltage ramp is 100-1000V.

29. The method of claim 27, wherein a rate of change of the time dependent voltage during the voltage ramp is from 0.1 V/ns to 10 V/ns (volts/nanosecond).

30. The method of claim 17, wherein the time-dependent potential is a non-linear voltage ramp.

* * * * *